United States Patent [19]

Ziehl

[11] 3,954,357

[45] May 4, 1976

[54] AIR PUMP PIVOT PIN RESTRAINT

[75] Inventor: Herbert E. Ziehl, Bridgeport, Mich.

[73] Assignee: General Motors Corporation, Detroit, Mich.

[22] Filed: May 24, 1974

[21] Appl. No.: 473,128

[52] U.S. Cl. ..... 418/138; 418/241

[51] Int. Cl.[2] ..... F01C 19/00

[58] Field of Search ..... 418/137, 138, 241

[56] References Cited

UNITED STATES PATENTS

| | | | |
|---|---|---|---|
| 846,844 | 3/1907 | Green | 418/138 |
| 993,053 | 5/1911 | Goehst et al. | 418/138 |
| 3,373,929 | 3/1968 | Partain | 418/138 |
| 3,419,208 | 12/1968 | Brewer et al. | 418/137 |
| 3,437,265 | 4/1969 | Rohde | 418/137 |

*Primary Examiner*—C. J. Husar
*Attorney, Agent, or Firm*—J. C. Evans

[57] ABSTRACT

A rotary pump includes a plurality of rotor driven radial vanes pivotally supported on a cantilevered pivot pin located centrally of a cylindrical pump housing by a first end fixed to a closure plate of the pump and a free end spaced with respect to the end plate of a cylindrical rotor. A pilot sleeve is press fit within a vane hub and the sleeve includes a bearing surface for rotatably supporting the pilot sleeve on the free end of the pivot pin and the sleeve further includes means for guiding the pilot sleeve within a grooved track in the end plate of the rotor so as to prevent deflection of the pivot pin and resultant wear of pump vane tips on the inner surface of a pump chamber.

3 Claims, 4 Drawing Figures

AIR PUMP PIVOT PIN RESTRAINT

This invention relates to rotary pumps including radial vanes and more particularly to such pumps including a fixed pivot pin for rotatably supporting radial vanes that are guided with respect to a pump working chamber by means of a cylindrical drive rotor having a drive shaft located eccentrically with respect to the pivot pin.

Vane type rotary mechanisms of the type disclosed in U.S. Pat. No. 3,437,264 have been found to be especially suited for use as pumps to produce air flow in an air injection reactor system wherein a stream of air is directed from the pump into the flow of hot exhaust gases as they are emitted from the combustion chambers of an internal combustion engine. The utilization of heat of the exhaust gases causes the injected air to support additional burning of exhaust gases in the engine exhaust passages to reduce the proportion of unburned exhaust gas constituents.

Such pumps are characterized by the provision of a plurality of radial vanes located within a circular housing cavity with each of the vanes being pivotally supported on a cantilevered pivot pin located on the axis of the pump cavity including one end fixedly secured to a pump cover plate and having a free end thereof located in spaced relationship to the end wall of a cylindrically configured rotor located eccentrically within the housing cavity and including a cylindrical outer surface thereon formed tangent to a stripper surface located between a pump inlet cavity and a pump discharge cavity in the outer housing.

In configurations of this type, the vane has a radially outwardly located tip that is engageable with a circular inner surface of the housing cavity and is formed of abradable material that causes the tips of the vanes to wear on the interior wall to form a slight clearance therebetween. The slight clearance reduces frictional resistance in the pump without seriously reducing its pumping efficiency. Under extreme conditions, dynamic deflection of the cantilevered air pump pivot pin can cause increased wear on the tips of the vane. Accordingly, an object of the present invention is to reduce the wear on the tips of pump vanes in compressors of this type by the provision therein of means for restraining the free end of a fixed pivot pin to reduce dynamic deflection thereof.

Yet another object of the present invention is to improve rotary machines of the type including radial vanes pivotally supported on a fixed cantilevered pivot pin located centrally of a working chamber and wherein a drive rotor for the vanes is located eccentrically within the working chamber and includes slots therein to couple the vanes to the rotor for rotating the vanes through the working chamber by the provision of a pilot sleeve to couple the free end of the fixed pivot pin to the rotor by means to prevent deflection of the pivot pin and resultant excessive wear of the vane tips on an inner surface of the working chamber; the pilot sleeve being configured to rotate with the vanes and the rotor so as to reduce relative motion and resultant wear therebetween.

Still another object of the present invention is to reduce dynamic deflection of a cantilevered pivot pin centered within a circular cavity of a rotary machine housing; the pin including one end fixed to an end cover plate and a free cantilevered end that supports hub portions of a radial vane that is driven through the cavity by means of a cylindrical rotor located eccentrically within the pump cavity and tangent to an inner cavity wall at one point thereon to separate an inlet chamber in the housing from a discharge chamber thereof by the provision of means for restraining the free end of the pin including a pilot sleeve having one end secured to the vane for rotation therewith and an opposite end thereof in engagement with a circular guide groove in the rotor defining a guide path following the path of rotation of the vane hub with respect to the rotor and wherein bearing means are connected between the pilot sleeve and the pin to permit free relative rotation of the vane and pilot sleeve with respect to the pivot pin.

Further objects and advantages of the present invention will be apparent from the following description, reference being had to the accompanying drawings wherein a preferred embodiment of the present invention is clearly shown.

Figure 1:
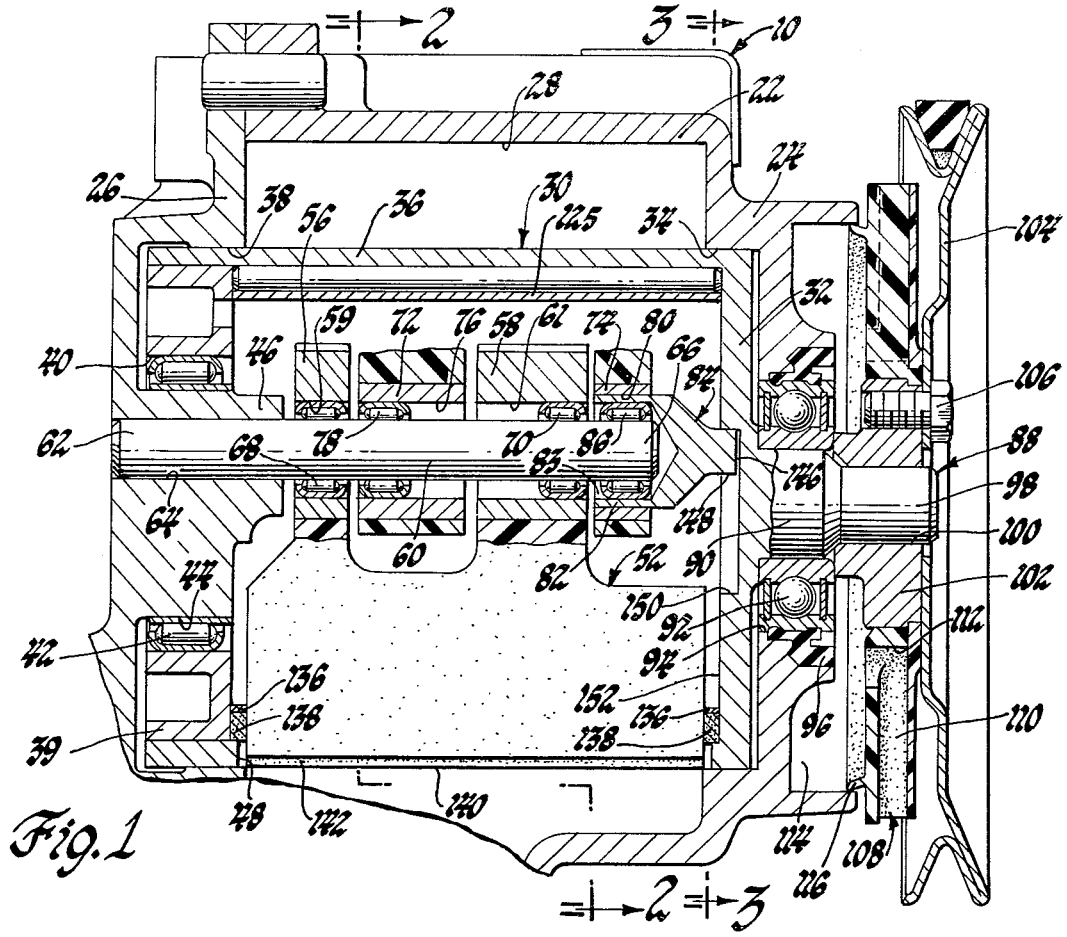
FIG. 1 is an axial sectional view of a vane type pump including the present invention.
Figure 2:
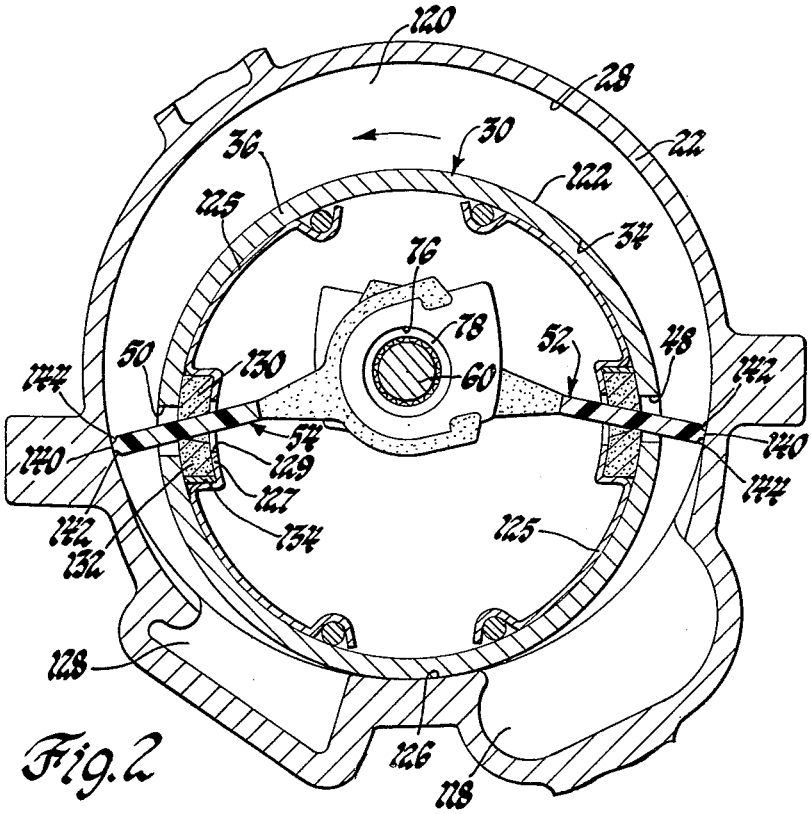
FIG. 2 is a vertical sectional view taken along the line 2—2 of FIG. 1 looking in the direction of the arrows.

Referring now to FIGS. 1 and 2, an air pump 10 is illustrated which has a concave housing 22 opened at one end and having an end closure 24 at its opposite end. The open end of the housing 22 is closed by a cover plate 26. As shown in FIG. 2, the inner circumferential wall 28 of the housing 22 between the end wall 24 and the cover plate 26 has a circular cross section to define a circular cavity through the housing 22. A rotor 30 is disposed within the housng 22 on an axis eccentric to the axis of the housing. It has an end wall 32 supportingly received within a recess 34 formed in the closure 24. A hollow cylinder 36 extends axially of the end wall 32 into a large diameter bore 38 of the cover plate 26. A cap 39 is inserted in the open end of the cylinder 36 to define an annular support surface 40 for a roller bearing 42 located between the cap 39 and a bearing surface 44 formed around an axially inwardly directed hub 46 on the cover plate 26.

The hollow cylinder 36 includes a pair of diametrically located longitudinal slots 48, 50 therein through which radial vanes 52, 54 respectively extend. The radial vane 52 includes a pair of hubs 56, 58 having bores 59, 61 therethrough located concentrically with respect to a pivot pin 60 extending centrally of the inner circumferential wall 28. The cantilevered pin 60 includes an end portion 62 thereon press fit within a bore 64 in in the hub 46 to fixedly secure the pivot pin 60 within cover plate 26. It further includes a free end 66 located in spaced axial relationship with the inner surface of the rotor end wall 32.

The pivot pin 60 supports a pair of spaced apart roller bearings 68, 70 located respectively within the hub bores 59, 61 to pivotally support the vane 52 for rotation with respect to the pin 60.

Likewise, the vane 54 includes a pair of hubs 72, 74. The hub 72 includes a bore 76 that receives a roller bearing 78 to rotatably support the hub 72 for rotation with respect to the pivot pin 60. The hub 74 includes a larger diameter oversized bore 80 therein that receives an open-ended tubular extension 82 of a pivot pin restraint member/pilot sleeve 84 which is press fit within the oversized bore 80 so as to rotate with the vane 54 with respect to the fixed pivot pin 60.

An inner surface 83 of the extension 82 has an inside diameter equal to the diameter of bores 59, 61, 76 to define a cavity for a roller bearing 86 that serves to rotatably support the hub portion 74 of vane 54 for movement with respect to the fixed pin 60.

As is best seen in FIG. 1, the rotor 30 includes an outwardly directed shaft 88 having a large diameter segment 90 thereon rotatably supported by a ball bearing 92 within a bore 94 in the end closure 24. A plastic insert 96 injected molded in the closure 24 locates the bearing 92 with respect to the housing 22 so as to maintain the rotor 30 against axial movement within the housing 22. The shaft includes an extension 98 thereon which is press fit within a bore 100 in a pulley hub 102. The pulley hub has a sheet metal pulley 104 fixedly secured thereto by suitable means including a plurality of circumferentially spaced screws, one of which is illustrated at 106 in FIG. 1.

An air cleaner 108 is secured about the pulley hub 102. It includes a plurality of radially directed passages 110 therein which connect with axially directed apertures 112 opening into an annular recess 114 on the outside of the closure 24. A lip 116 on the air cleaner 108 seals the open end of the annular recess 114.

Air flow from the annular recess 114 is to an inlet chamber 118, best shown in FIG. 2, that communicates with a crescent-shaped pump chamber 120 formed between the outer periphery 122 of the rotor 30 and the inner wall 28. Because of the eccentric relationship between the rotor 30 and the cavity of the housing 22, the outer periphery 122 is formed tangentially with respect to a stripper surface 126 formed between the inlet chamber 118 and a discharge chamber 128 in communication with a discharge conduit (not shown). As shown in FIGS. 1 and 2 and with specific reference to FIG. 2, metal liners 125 are formed into outwardly extending recesses extending radially inwardly of rotor 30 at 127 and include slots 129 therein through which the vanes 52, 54 extend. The recess liners 125 define channels adjacent the slots 48, 50 in the rotor 30 to support carbon drive and follower bearing shoe strips 130, 132. Leaf-type springs 134 bias follower shoes 132 against the vanes 52, 54. The strips 130, 132 define a bearing surface for the vanes 52, 54 and also serve to close the slots 48, 50 to seal the pump chamber 120 from the interior of the rotor 30.

The slots 129 do not extend the entire axial length of the liners 125. The point at which they terminate short of the ends of the rotor defines straps 136 to retain small arcuate carbon shoe strips 138 at each end of the vanes 52, 54 against which the ends of the vanes bear during rotation thereof by the rotor 30 with respect to the inner wall 28.

Each of the vanes 52, 54 include a radially outwardly located tip 140 thereon that is undercut at 142 and 144 on opposite sides thereof. The vanes are preferably molded from a thermosetting plastic resin reinforced with random glass fibers and are of a radial length to locate the tips 140 in contact with the inner wall 28. Thus, during initial running of the pump, the tips of the vanes will abrade on the inner wal 28 to form a slight clearance between the vanes 52, 54 and the wall 28. This clearance reduces frictional resistance within the pump without seriously reducing its pumping efficiency.

The basic pumping action is produced by rotation of the pulley 104 that drives the rotor 30 about the axis of the shaft 88. The eccentrically located rotor 30 will guide the vanes 52, 54 in an arcuate path from the inlet chamber 118 through the crescent-shaped pumping chamber 120 thereby to draw air from the inlet chamber 118 for discharge through the discharge chamber 128. The vanes 52, 54 have their hubs supported on the pivot pin 60 by means of the roller bearings 68, 70, 78 and 86 to pivot with respect to the fixed pivot pin 60 as they are guided by the rotor 30 through the pump chamber 120.

Figure 3:
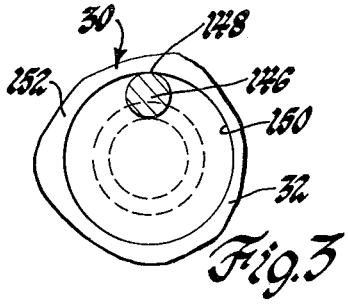
FIG. 3 is a fragmentary vertical sectional view taken along the line 3—3 of FIG. 1, looking in the direction of the arrows.
Figure 4:
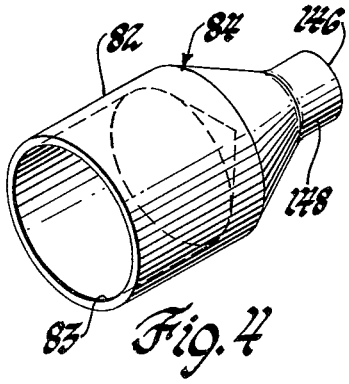
FIG. 4 is a view in perspective of a pilot sleeve component of the present invention.

During such rotation, dynamic forces acting upon the pivot pin 60 will tend to produce dynamic deflection thereof with respect to inner wall 28 thereby producing greater or less clearance between vane tips 140 and inner wall 28. In accordance with the present invention, the pilot sleeve 84 is configured to restrain such dynamic deflection thereby to avoid vane tip wear. The restraint is produced by utilization of a pilot sleeve 84 that is rotated along with the vanes 52, 54 as it is guided by the rotor 30 with respect to the pump chamber 120. More particularly, as seen in FIG. 3, the sleeve 84, in addition to including the tubular extension 82 press fit in the vane hub 74 for rotation therewith, further includes a cylindrical tip portion 146 that has an outer circumferential surface 148 thereon located in guided engagement with a circular guide track 150 formed in the inner end face 152 of the rotor 30. The tip portion 146 has its longitudinal axis located coaxial of the longitudinal axis of pin 60. Thus, during rotation of the rotor 30, and rotary movement of the vanes 52, 54 with respect to the fixed pivot pin 60, the sleeve 84, by virtue of its press fit relationship with the hub 74 and its rotative support on the pivot pin 60 by the bearing 86 will rotate with the rotor 30 and will be guided by the track 150 to prevent excessive movement therebetween while defining a restraint against deflection of the cantilevered pivot pin 60 with respect to the inner wall 28 of the outer housing 22. This restraint will control excessive dynamic deflection of the pivot pin 60 to meet the objective of reduced wear at the vane tips 140.

While the embodiments of the present invention, as herein disclosed, constitute a preferred form, it is to be understood that other forms might be adopted.

What is claimed is:

1. In a rotary vane compressor of the type including a housing having a circular cavity therein closed at one end by a cover plate that fixedly supports a cantilevered pivot pin centrally of the housing cavity and further including a cylindrical rotor located eccentrically of the circular cavity having an inner end face and having a rotor drive shaft formed eccentrically of the pivot pin to drive radial vanes pivotally supported on the pin for rotation relative thereto and through a vane path that sweeps a crescent-shaped pump chamber between the housing and the rotor to draw fluid from an inlet chamber for discharge through an outlet chamber, the improvement comprising: means forming a circular guide track in the inner end face of said rotor located concentrically of said rotor shaft and eccentrically with respect to the axis of said pivot pin, a vane hub having a bore therethrough supported in spaced relationship to the free end of said pivot pin, a pivot pin restraint member including an open ended tubular end portion thereon press fit within said hub bore, bearing means supported between the inner surface of said open ended tubular extension and the outer surface of said pivot pin at the free end thereof to rotatably support said restraint member on the free end of the pivot pin, an extension on said rotatable restraint member piloted within said circular guide track to guidingly restrain deflection of said free end of said pivot pin to reduce wear on the tips of said vanes as they sweep across the inner surface of said housing.

2. An air pump assembly comprising an outer housing having a closed end and an open end defining a circular inner wall forming a cavity, a cover plate closing the open end of said housing, a pivot pin supportingly received on said cover plate extending axially of said cavity along the longitudinal axis thereof, a drive rotor including an end plate rotatably supported within the closed end of said housing and including a drive shaft extending from the closed end of said housing having an axis of rotation eccentric to that of said pivot pin, said rotor includng a cylinder extending longitudinally of said working chamber from said rotor end plate and including an open end thereof supportingly received within said cover plate for rotation relative thereto, said rotor cylinder including a longitudinal groove therein, a radial vane directed through said groove including a tip portion thereon engageable with said housing wall during rotation of said rotor, said vane including a hub portion located in surrounding relationship to the free end of said pin axially inwardly of the inner face of said rotor end plate, said hub including an oversized bore therein, a pilot sleeve having an open ended tubular portion thereon press fit within said oversized bore, bearing means located between the inner surface of said tubular portion and the outer surface of the free end of said pivot pin for rotatably supporting said pilot sleeve on the free end of said pivot pin, said pilot sleeve including a tip thereon having a longitudinal axis coaxial of the axis of said pivot pin, means forming a circular guide track in the inner face of said rotor located concentrically of the axis of the drive shaft of said rotor, said sleeve extension being piloted into said groove and being located in supported relationship with the outer periphery of said circular guide track to control deflection of said pivot pin during rotation of said vanes within the housing by said rotor thereby to reduce wear of said vane tips during passage thereof with respect to the inner surface of said housing.

3. A rotary machine comprising an outer housing having a closed end and an open end and including a circular inner wall forming a cavity between said closed and open ends, a cover plate on said housing to close the open end thereof, a rotor having an end plate thereon supportingly received for rotation within the closed end of said housing and including a cylindrical extension directed longitudinally of said cavity, said cylindrical extension being supportingly received within said cover plate for rotation with respect thereto, said rotor having a shaft extending from the closed end of said housing located eccentrically with respect to the centerline of said circular cavity, said housing having an inlet chamber and a discharge chamber formed therein separated by an arcuate stripper surface therebetween, said rotor including an outer circumferential surface thereon located tangent to said stripper surface and forming a crescent-shaped pump chamber with said housing, a pivot pin havng one end thereof fixedly secured to said cover plate directed longitudinally within said housing along the centerline thereof and including a free end thereof axially spaced from the end wall of said rotor, a longitudinal slot in said rotor cylinder, a pump vane directed through said slot including a radial outer edge thereon engageable with said inner wall, said vane including a pair of spaced apart hubs thereon, one of said hubs having a bore therethrough located in concentric surrounding relationship with said pivot pin, first bearing means located within said last mentioned bore for supporting said vane hub for rotation with respect to said pivot pin, a second hub on said vane having an over-sized bore therein located concentrically of the pivot pin at the free end thereof, a pilot sleeve including an open ended portion thereon press fit within said oversized bore to locate said pilot sleeve so as to enclose the free end of said pivot pin, second bearing means supported between the inner surface of said tubular portion and the outer circumference of said pivot pin at the free end thereof to support said pilot sleeve for rotation upon the free end of said pivot pin, said rotor including a circular guide groove formed therein concentrically of said drive shaft on the inner face of the end plate of said rotor, said sleeve including a cylindrical tip thereon coupling the free end of said pivot pin to said rotor to prevent deflection of said pivot pin, said guide groove and said pilot sleeve rotating together so as to reduce relative motion therebetween thereby to prevent deflection of the pivot pin and resultant wear of vane tips during passage thereof across said inner wall.

* * * * *